US009672798B1

(12) United States Patent
Codner et al.

(10) Patent No.: US 9,672,798 B1
(45) Date of Patent: Jun. 6, 2017

(54) SYSTEMS AND METHODS FOR PROVIDING DECORATIVE DRUM SHELL WRAPS

(71) Applicant: FLEXcon Company, Inc., Spencer, MA (US)

(72) Inventors: Peter Codner, Spencer, MA (US); Ronald Ducharme, Dudley, MA (US); Kenneth Koldan, Rockford, IL (US)

(73) Assignee: FLEXcon Company, Inc., Spencer, MA (US)

( * ) Notice: Subject to any disclaimer, the term of this patent is extended or adjusted under 35 U.S.C. 154(b) by 426 days.

(21) Appl. No.: 14/093,345

(22) Filed: Nov. 29, 2013

Related U.S. Application Data

(60) Provisional application No. 61/731,292, filed on Nov. 29, 2012.

(51) Int. Cl.
*G10D 13/02* (2006.01)

(52) U.S. Cl.
CPC ..... *G10D 13/028* (2013.01)

(58) Field of Classification Search
CPC ..... G10D 13/02; G10D 13/028; G10D 3/00; Y10T 428/1348
USPC ..... 84/411 R, 452 P
See application file for complete search history.

(56) References Cited

U.S. PATENT DOCUMENTS 4,308,782 A 1/1982 Hartry
5,581,044 A 12/1996 Belli et al.
6,297,177 B1 10/2001 Belli et al.
6,365,812 B1 4/2002 McGill
6,497,598 B2 12/2002 Affinito
6,838,606 B2 1/2005 Chiang
7,439,432 B2 10/2008 Hiraku
7,795,519 B2 9/2010 Hsien
8,148,617 B2 4/2012 Hashimoto et al.
2002/0058144 A1* 5/2002 Mori ..... B29C 45/14811 428/412
2005/0109190 A1 5/2005 Smith et al.
2007/0178277 A1* 8/2007 Lu ..... B32B 7/12 428/137
2012/0097009 A1 4/2012 Eventoff et al.
2012/0180621 A1 7/2012 Holl
2014/0009836 A1* 1/2014 Weber ..... G02B 5/09 359/599
2016/0148894 A1* 5/2016 Zhu ..... C09J 163/10 257/746

FOREIGN PATENT DOCUMENTS

GB 2113888 A 8/1983
GB 2467372 A 8/2010

OTHER PUBLICATIONS

"Remo Drumhead Selection Guide" (2010) by Remo, Inc., 38 pages. http://drumsonsale.com/DrumResourceRoom/Remo/DH+Mini+Catalog_email_FINAL.pdf.

* cited by examiner

*Primary Examiner* — Kimberly Lockett
(74) *Attorney, Agent, or Firm* — Gesmer Updegrove LLP

(57) ABSTRACT

A drum shell wrap is disclosed that includes at least two layers of an acrylic film and a plurality of layers of polyethylene terephthalate (PET).

34 Claims, 7 Drawing Sheets

SYSTEMS AND METHODS FOR PROVIDING DECORATIVE DRUM SHELL WRAPS

CROSS REFERENCE TO RELATED APPLICATION

This application claims priority from U.S. Provisional Application Ser. No. 61/731,292 filed Nov. 29, 2012, the entire content of which is incorporated herein in its entirety.

BACKGROUND

Many musical (acoustic) drums are formed with top and bottom surfaces (or heads), separated by a cylindrical structure. The top head receives the percussion impact (e.g., from a stick or a brush), and the function of the bottom head is to reflect the vibrations from the top head, thus improving the fullness of the sound. The cylindrical shell sets the separation of the two heads and allows the pressure wave created by a drum strike to the first head to remain contained so as to produce a resonant frequency on the second head. A drum wrap may be intimately bonded to the shell (e.g., formed of a thermoformed laminated wood or plastic), and in most cases the wrap itself undergoes a thermal forming process when being attached to the cylinder.

Many typical drum shell wraps used today consist two acrylic films bonded together by an adhesive layer, and the films may range between 10-20 mil (250-500 microns), most often each at 15 mil (300 micron). The thickness of the adhesive layer may range between 1-6 mil (25-150 microns) and may be either clear or tinted or pigmented. For example, FIG. 1 shows a prior art drum wrap that includes first and second layers 10, 12 or an acrylic film (each 10-20 mil) that are bonded together by an adhesive layer 14.

While decorative wrappings on musical drums may serve decorative purposes or may be informative, for example, identifying the name of a band, it has been discovered that such drum shell wraps may also negatively impact the sound and performance of a drum.

SUMMARY

In accordance with an embodiment, the invention provides a drum shell wrap that includes at least two layers of an acrylic film and a plurality of layers of polyethylene terephthalate (PET). In accordance with another embodiment, the invention provides a method of providing a drum shell wrap, wherein the method includes the steps of removing a release liner from a first composite that includes at least one layer of polyethylene terephthalate (PET) and at least one layer of an acrylic film, and a second composite that includes at least one layer of PET and at least one layer of an acrylic film, and then laminating the first and second composites together.

In accordance with a further embodiment, the invention provides a drum shell wrap comprising two outer acrylic film layers and a plurality of layers of polyethylene terephthalate (PET) between the outer acrylic film layers, wherein the drum shell wrap has a tan δ of at least 0.2, and wherein a layer of printing or other indicia is provided between at least two of the plurality of layers of polyethylene terephthalate

BRIEF DESCRIPTION OF THE DRAWINGS

The following description may be further under stood with reference to the accompanying drawings in which.

The drawings are shown for illustrative purposes only.

DETAILED DESCRIPTION

An object of the invention was to determine in what way music may be altered by a drum shell wrap, and then to determine how to construct a drum shell wrap that would minimize or eliminate any such problem. To this end, the Dynamic Mechanical Analysis (DMA) method was used to classify how drum wraps could affect the complex vibrations occurring while playing the drums. It was discovered that a decorative drum shell wrap may be fabricated that had a low loss factor vs. its storage modulus. In other words, a material was developed having a low damping coefficient or dissipation factor, i.e., a low tan δ, which is the ratio of the loss factor and the storage modulus for a given composite.

Figure 1:
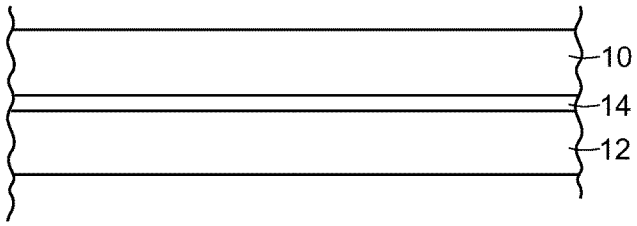
FIG. 1 (PRIOR ART)
FIG. 1 shows an illustrative diagrammatic view of a drum shell wrap of the prior art.

DMA testing of a drum wrap such as shown in FIG. 1 was done on a TA Q 800, from TA Instruments, New Castle, Del. The temperature was at 75° F. (24° C.), with a frequency sweep of 0-87 Hz (single mode drum frequency~70-80 Hz). With reference to FIG. 1, the sample included a 15 mil acrylic/2 mil adhesive/15 mil acrylic composite.

Figure 2:
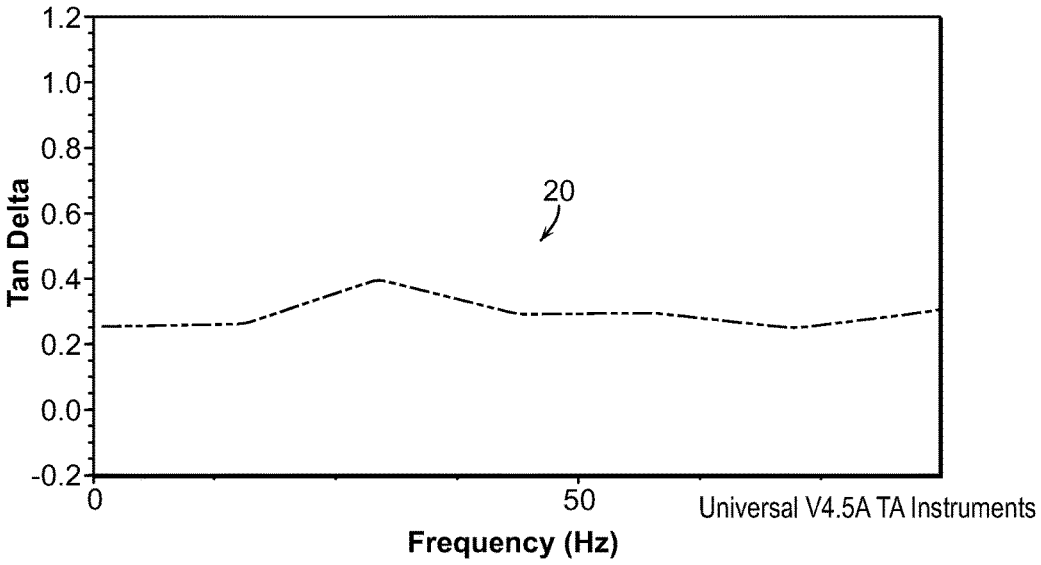
FIG. 2 shows an illustrative graphical representation of tan δ versus frequency for a drum shell wrap of the prior art.

As shown at 20 in FIG. 2, the result of the testing showed a tan δ across the frequency range from ~0.25~0.4. The higher the tan δ, the more vibration energy is absorbed by the system, and conversely the lower the tan δ the more the vibrational energy bounces back into the system.

To construct a drum wrap laminate with a lower tan δ it was determined that a higher internal modulus film like PET could be substituted for some of the thickness of the acrylic film. It was further determined that at least one acrylic layer should remain given the UV transparency of acrylics, and their thermal forming properties, clarity retention and the known ability to bond to drum shells the industry.

Figure 3:
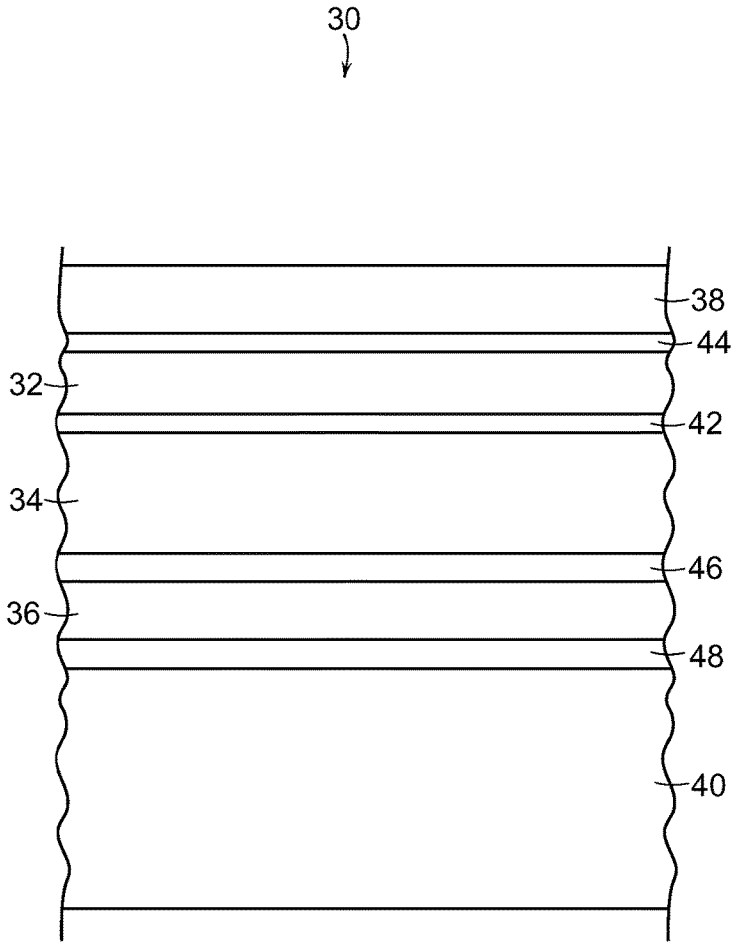
FIG. 3 shows an illustrative diagrammatic view of a drum shell wrap in accordance with an embodiment of the invention.

In accordance with an embodiment of the invention, a composite structure such as shown in FIG. 3 was developed that included a plurality of layers of polyethylene terephthalate (PET) 32, 34, 36 between two acrylic layers 38, 40. The composite includes an acrylic component on both the top (38) and the bottom (40). The three PET layers 32, 34, 36 are sandwiched between the acrylic top layer 38 and acrylic bottom layer 40. The top two PET layers (e.g., a 2 mil PET layer and a 5 mil PET layer as shown at 32, 34) are bonded together using a heat activated adhesive 42, and the top acrylic layer 38 is bonded to the uppermost PET layer 32 also using a heat activated adhesive 44, e.g., the V-45 heat activated adhesive sold by FLEXcon Company, Inc. of Spencer, Mass. The 5 mil PET layer 34 is bonded to the PET layer 36 (e.g., also 2 mil) by a pressure sensitive adhesive layer 46, and the PET layer 36 is bonded to the acrylic bottom layer 40 by a pressure sensitive adhesive 48.

The layering of the PET layers provides another advantage in addition to lowering the tan δ value. Acrylics as a family are fairly UV transparent. While this is an excellent property for an item which may be displayed in store windows and/or used under harsh lighting conditions, UV radiation however, can damage materials such as printing inks below the surface of the top acrylic layer. UV radiation damages materials that absorb the UV radiation. If, for example, there were some underlying color layer or graphics, those entities could fade or blacken with expose to even near UV radiation.

In the construction shown in FIG. 3 the first layer of PET 32 may include UV absorbers available from most PET film suppliers. In further embodiments, the heat activated adhesive may further contain UV absorbers. Such a combination would offer protection to any colored or graphic layer that may come next in the composite, e.g., on the lowermost PET layer as discussed below with reference to FIG. 6.

Figure 4:
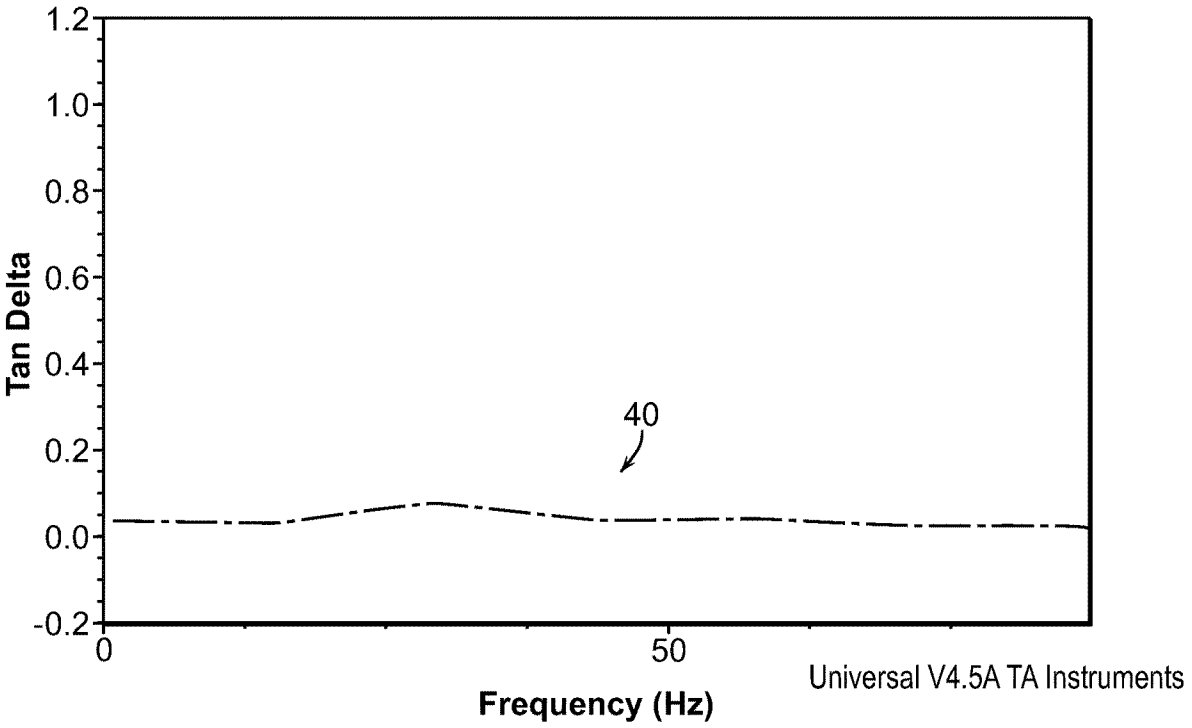
FIG. 4 shows an illustrative graphical representation of tan δ versus frequency for a drum shell wrap of FIG. 3.
Figure 5:
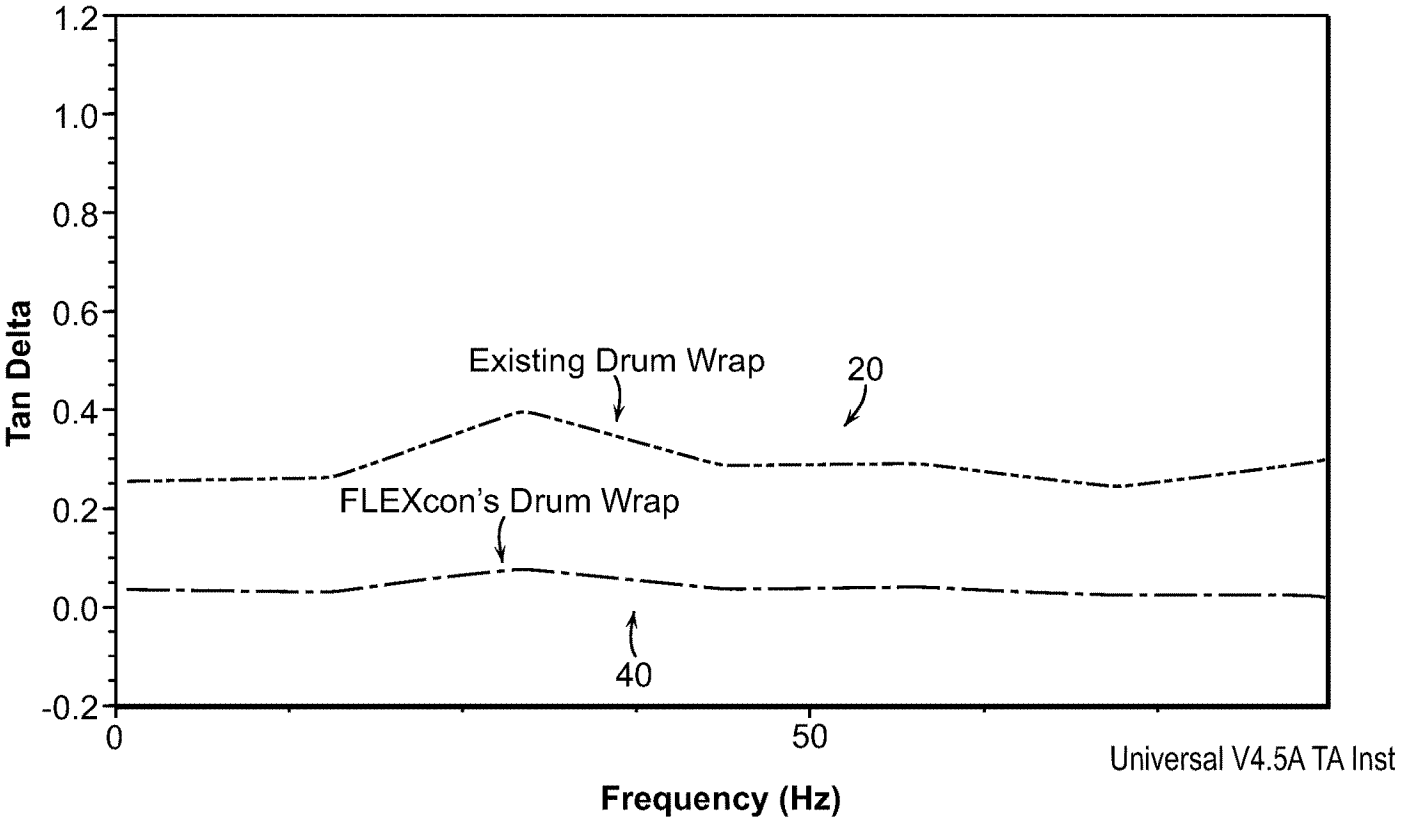
FIG. 5 shows an illustrative graphical representation of the tan δ versus frequency values shown in FIGS. 2 and 4 combined on the same graph.

A film composite 30 such as described with reference to FIG. 3 was tested in the TA Q800 DMA as discussed above with reference to FIG. 2. The results are shown at 40 in FIG. 4. Here, the tan δ is less than a third of that from the first all acrylic drum wrap composite of FIG. 1. FIG. 5 shows both results (shown at 20 from FIG. 2 and shown at 40 from FIG. 4) on the same chart.

Figure 6A:
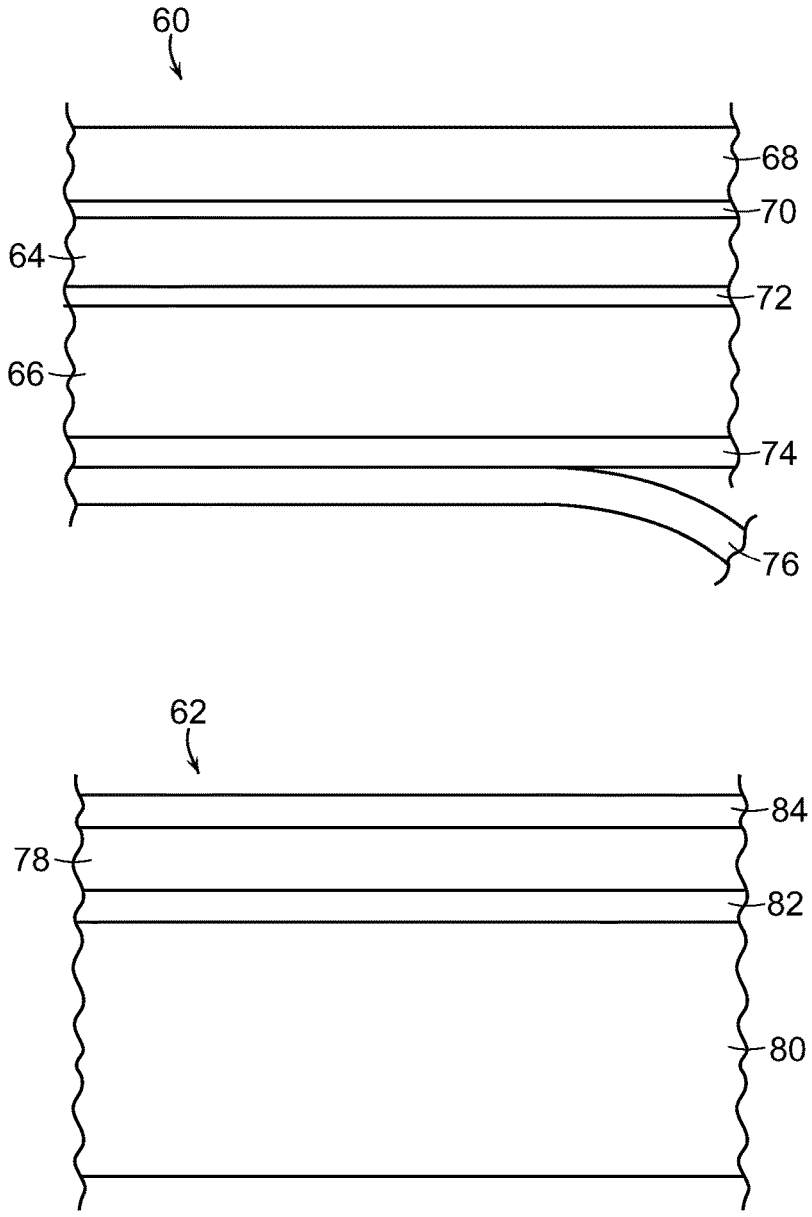
FIGS. 6A-6C show illustrative diagrammatic views of steps involved in forming a drum shell wrap of FIG. 3 in accordance with another embodiment of the present invention.
Figure 6B:
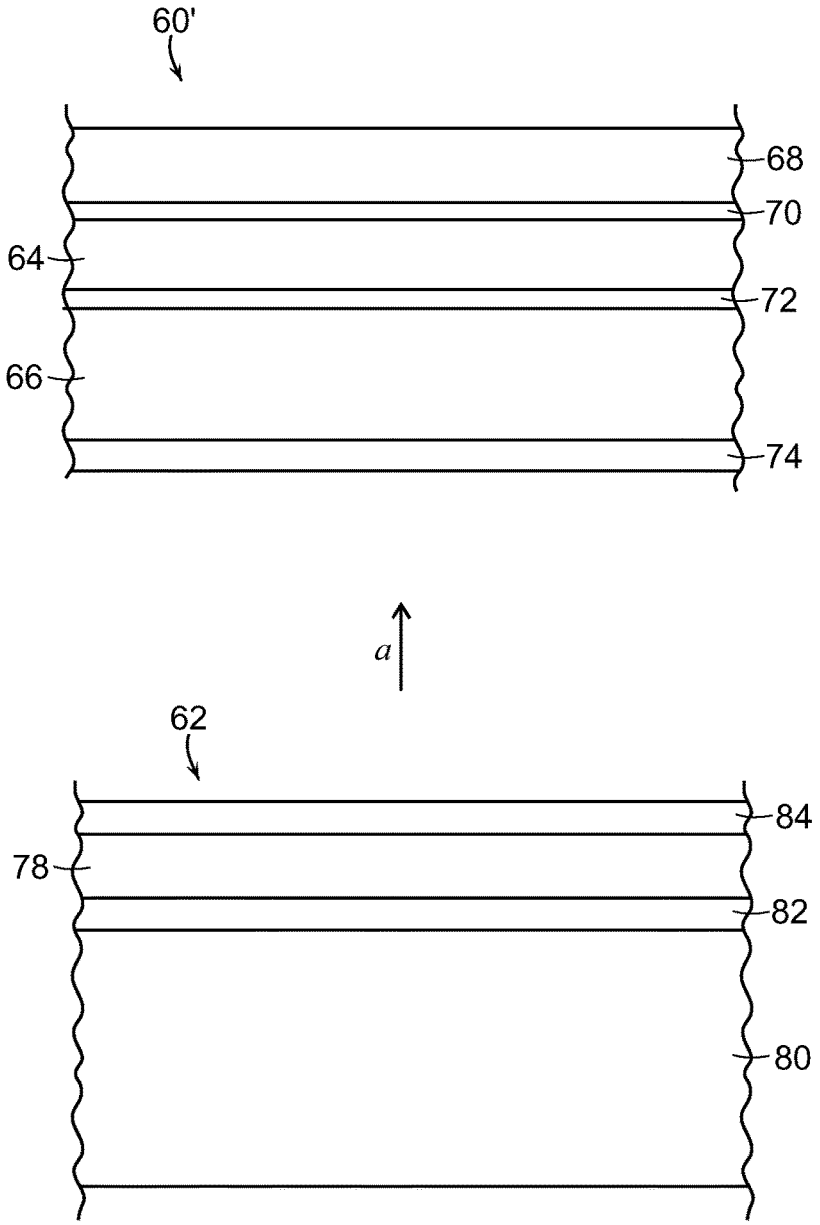
Figure 6C:
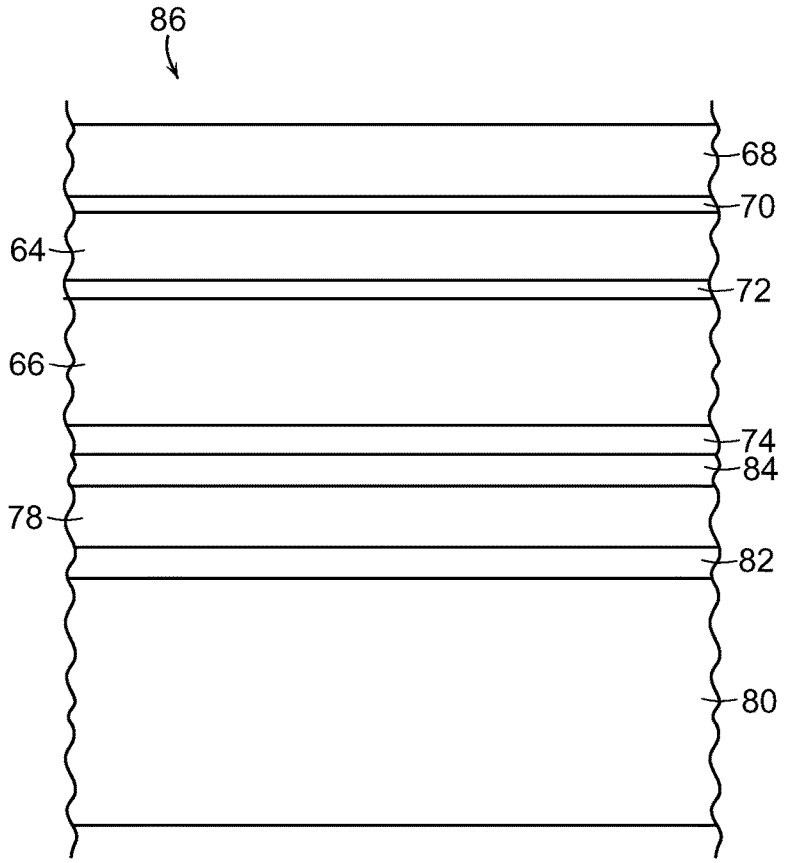

As shown in FIGS. 6A-6C, composites in accordance with a further embodiment may be provided in two component parts 60, 62 that are combined. In particular and as shown in FIG. 6A, the first component 60 includes two PET layers 64, 66 as well as an acrylic layer 68. The acrylic layer 68 is joined to the PET layer (e.g., 2 mil) by a heat activated adhesive 70, and is bonded to the PET layer 66 (e.g., 5 mils) by a heat activated adhesive 72. The PET layer 66 also includes a pressure sensitive adhesive layer 74 on the exposed side together with a siliconized removable release line 76.

The second component 62 includes a PET layer 78 (e.g., 2 mil) that is bonded to an acrylic layer 80 (e.g., 9 mil) by a pressure sensitive adhesive layer 82. In this embodiment, the second component 62 may also include printing or other indicia 84 of the exposed side of the PET layer 78.

As shown in FIG. 6B, after the release liner 76 is removed from the pressure sensitive adhesive layer 72, the second component 62 may be joined to the first component 60' as shown at a. As shown at 86 in FIG. 6C, the resulting drum shell wrap 86 may provide multiple layers of PET (64, 66, 78) and outer layers of acrylic (68, 80) as well as a layer of printing or other indicia 84 within the composite. This permits the wrap to be printed on the 2 mil PET layer, and then covered by the upper portion, which will provide the UV protection. This allows the lower half of the composite to be made with various background colors, either by choosing a white or black, for example, PET, or coated with a metal flake ink or a micro embossed (holographic) design, or some other print graphic, then removing the release liner and laminating this first composite over said color or graphic design forming the final construction. In this fashion the color or graphic designs are protected from physical abrasion and UV light, accidental liquid spills, etc.

Those skilled in the art will appreciate that other combinations of fewer or more PET inclusions in the composite structure may be defined and fabricated. An important aspect however, is that the tan δ as determined by DMA over the defined frequency range and room temperature is less than 0.25, preferably less than 0.125 and most preferably less than 0.05.

A decorative drum shell wrap is provided therefore, consisting of at least two layers of an acrylic film, placed on the first (or top) layer and the last (bottom) layer of a multilayer construction, the intermediate layers includings bonding layers and PET film, with the total composite having a tan δ of less than 0.25 when run on a DMA at room temperature and between 0-87 Hz. In an embodiment, at least one PET film (and preferable the one just after the top acrylic layer) includes UV resistant material.

Those skilled in the art will appreciate that numerous modifications and variations may be made to the above disclosed embodiments without departing from the spirit and scope of the present invention.

What is claimed is:

1. A drum shell wrap comprising at least two layers of an acrylic film and a plurality of layers of polyethylene terephthalate (PET), wherein said drum shell wrap has a tan δ of less than about 0.2, wherein said drum shell wrap is provided as a two part construction to be laminated after printing.

2. The drum shell wrap as claimed in claim 1, wherein said plurality of layers of polyethylene terephthalate are sandwiched between at least two of the at least two layers of acrylic film.

3. The drum shell wrap as claimed in claim 1, wherein at least one layer is UV resistant.

4. The drum shell wrap as claimed in claim 1, wherein said drum shell wrap includes three layers of PET film.

5. The drum shell wrap as claimed in claim 1, wherein said drum shell wrap includes a layer of printing or other indicia within the drum shell wrap.

6. The drum shell wrap as claimed in claim 5, wherein said drum shell wrap includes at least one layer of the layers of polyethylene terephthalate on either side of the layer of printing or other indicia.

7. A method of providing a drum shell wrap, said method comprising the steps of removing a release liner from a first composite that includes at least one layer of polyethylene terephthalate (PET) and at least one layer of an acrylic film, providing a second composite that includes at least one layer of PET and at least one layer of an acrylic film, and laminating the first and second composites together.

8. The method as claimed in claim 7, wherein said method further includes the step of applying graphics to an exposed surface of said second composite prior to the step of laminating the first and second composites together.

9. The method as claimed in claim 7, wherein at least one film is UV resistant.

10. The method as claimed in claim 7, wherein said drum shell wrap has a tan δ of less than about 0.2.

11. The method as claimed in claim 7, wherein said drum shell wrap includes three layers of PET film.

12. A drum shell wrap comprising two outer acrylic film layers and a plurality of layers of polyethylene terephthalate (PET) between the outer acrylic film layers, wherein the drum shell wrap has a tan δ of less than about 0.2, and wherein a layer of printing or other indicia is provided between at least two of the plurality of layers of polyethylene terephthalate.

13. The drum shell wrap as claimed in claim 12, wherein at least one layer is UV resistant.

14. The drum shell wrap as claimed in claim 12, wherein said drum shell wrap includes three layers of PET film.

15. The drum shell wrap as claimed in claim 12, wherein said drum shell wrap is provided as a two part construction to be laminated after printing.

16. A drum shell wrap comprising at least two layers of an acrylic film and a plurality of layers of polyethylene terephthalate (PET), wherein said drum shell wrap is provided as a two part construction to be laminated after printing.

17. The drum shell wrap as claimed in claim 16, wherein said plurality of layers of polyethylene terephthalate are sandwiched between at least two of the at least two layers of acrylic film.

18. The drum shell wrap as claimed in claim 16, wherein at least one layer is UV resistant.

19. The drum shell wrap as claimed in claim 16, wherein said drum shell wrap has a tan δ of less than about 0.2.

20. The drum shell wrap as claimed in claim 16, wherein said drum shell wrap includes three layers of PET film.

21. The drum shell wrap as claimed in claim 16, wherein said drum shell wrap includes a layer of printing or other indicia within the drum shell wrap.

22. The drum shell wrap as claimed in claim 21, wherein said drum shell wrap includes at least one layer of the layers of polyethylene terephthalate on either side of the layer of printing or other indicia.

23. A drum shell wrap comprising at least two layers of an acrylic film and a plurality of layers of polyethylene terephthalate (PET), wherein said drum shell wrap includes a layer of printing or other indicia within the drum shell wrap, and wherein said drum shell wrap includes at least one layer of the layers of polyethylene terephthalate on either side of the layer of printing or other indicia.

24. The drum shell wrap as claimed in claim 23, wherein said plurality of layers of polyethylene terephthalate are sandwiched between at least two of the at least two layers of acrylic film.

25. The drum shell wrap as claimed in claim 23, wherein at least one layer is UV resistant.

26. The drum shell wrap as claimed in claim 23, wherein said drum shell wrap has a tan δ of less than about 0.2.

27. The drum shell wrap as claimed in claim 23, wherein said drum shell wrap includes three layers of PET film.

28. The drum shell wrap as claimed in claim 23, wherein said drum shell wrap is provided as a two part construction to be laminated after printing.

29. A drum shell wrap comprising at least two layers of an acrylic film and a plurality of layers of polyethylene terephthalate (PET), wherein said drum shell wrap has a tan δ of less than about 0.2, wherein the drum shell wrap includes a layer of printing or other indicia within the drum shell wrap, and wherein said drum shell wrap includes at least one layer of the layers of polyethylene terephthalate on either side of the layer of printing or other indicia.

30. The drum shell wrap as claimed in claim 29, wherein said plurality of layers of polyethylene terephthalate are sandwiched between at least two of the at least two layers of acrylic film.

31. The drum shell wrap as claimed in claim 29, wherein at least one layer is UV resistant.

32. The drum shell wrap as claimed in claim 29, wherein said drum shell wrap includes three layers of PET film.

33. The drum shell wrap as claimed in claim 29, wherein said drum shell wrap is provided as a two part construction to be laminated after printing.

34. The drum shell wrap as claimed in claim 29, wherein said drum shell wrap includes a layer of printing or other indicia within the drum shell wrap.

* * * * *